United States Patent [19]

Willis

[11] 4,438,640

[45] Mar. 27, 1984

[54] PORTABLE DOOR BRACE

[76] Inventor: Robert E. Willis, 6606 N. Saginaw, Flint, Mich. 48505

[21] Appl. No.: 532,083

[22] Filed: Sep. 13, 1983

Related U.S. Application Data

[63] Continuation-in-part of Ser. No. 212,834, Dec. 4, 1980, abandoned.

[51] Int. Cl.[3] ..... E05B 64/00; E05C 17/54

[52] U.S. Cl. ..... 70/94; 292/339

[58] Field of Search ..... 292/339, 338, 262, 263, 292/DIG. 15; 254/39; 16/326-332; 70/94

[56] References Cited

U.S. PATENT DOCUMENTS

| | | | |
|---|---|---|---|
| 127,519 | 6/1872 | Russell | 292/263 |
| 197,187 | 11/1877 | Voege | 254/39 |
| 503,536 | 8/1893 | Hales | 254/39 |
| 561,373 | 6/1896 | Campbell | 292/338 |
| 790,653 | 5/1905 | Notthoff | 292/339 |
| 991,241 | 5/1911 | Rae | 292/DIG. 15 |
| 1,246,160 | 11/1917 | Roberts | 254/39 |
| 1,495,509 | 5/1924 | Clark | 292/363 |
| 1,560,562 | 11/1925 | Golding | 292/338 |
| 1,580,289 | 4/1926 | Cummings | 292/263 |
| 1,626,007 | 4/1927 | Mitchell | 292/338 |
| 1,631,980 | 6/1927 | Piccirilli | 292/338 |
| 1,754,579 | 4/1930 | Sponsler | 292/263 |
| 1,967,592 | 7/1934 | Rawlings | 292/263 |
| 2,013,418 | 9/1935 | Moore | 292/263 |
| 3,825,290 | 7/1974 | Messina | 292/262 |
| 4,070,049 | 1/1978 | Brewer | 292/263 |
| 4,076,293 | 2/1978 | Valles | 292/338 |
| 4,157,128 | 6/1979 | Peters | 292/339 |
| 4,290,636 | 9/1981 | Steele | 292/338 |

FOREIGN PATENT DOCUMENTS

| | | | |
|---|---|---|---|
| 2800985 | 7/1979 | Fed. Rep. of Germany | 292/263 |
| 171128 | 11/1921 | United Kingdom | 16/331 |
| 321127 | 10/1939 | United Kingdom | 292/263 |

*Primary Examiner*—Robert L. Wolfe

*Attorney, Agent, or Firm*—Wilson, Fraser, Barker & Clemens

[57] ABSTRACT

A door brace is disclosed adapted to interengage a door and a floor beneath the door and prevent unauthorized entry through the door. The brace comprises sections interconnected substantially end-to-end and collapsible with respect to each other into a compact form. One end section of the prop member has means adapted to engage the door, while the other end section has pivotally mounted base means adapted to engage the floor. Optionally, the prop member has lock means adapted to extend from the prop member to an exterior side of the door where the lock means is operable for locking or unlocking. The prop member may also have pressure-sensitive means adapted to signal a warning upon pressure upon the prop member due to unauthorized attempt to open the door.

4 Claims, 15 Drawing Figures

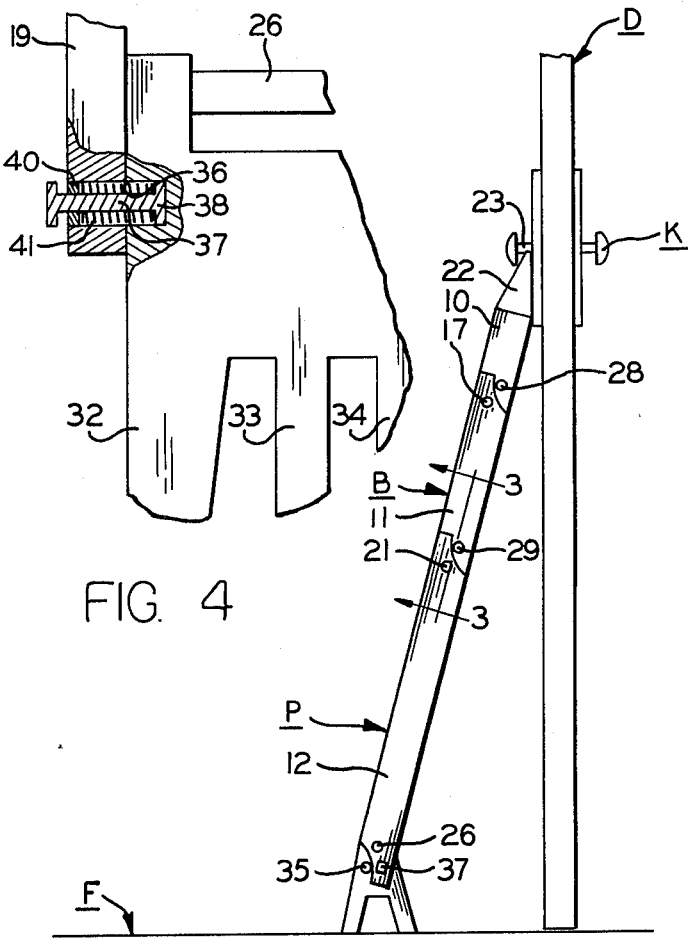
FIG. 4
FIG. 1
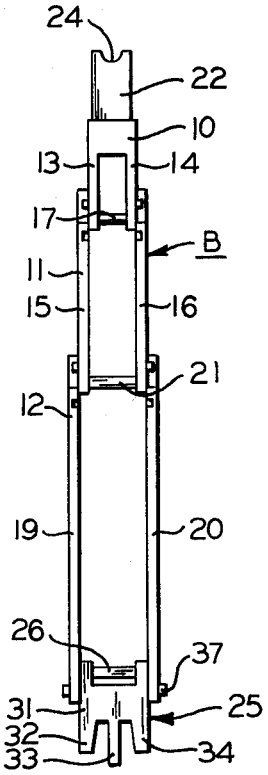
FIG. 2
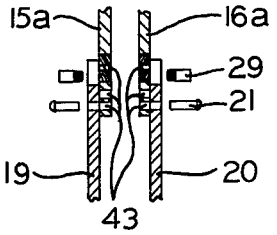
FIG. 3
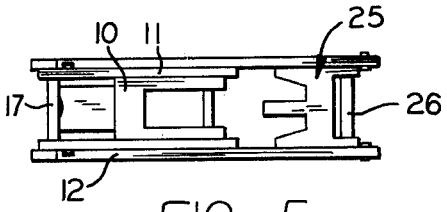
FIG. 5
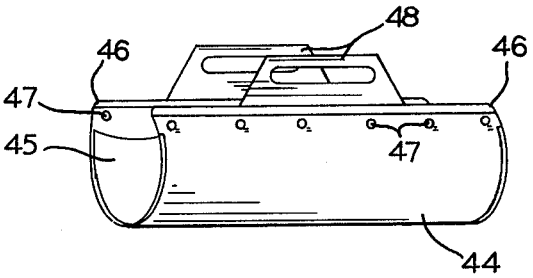
FIG. 6

PORTABLE DOOR BRACE

CROSS-REFERENCE TO RELATED APPLICATION

This application is a continuation-in-part application of my co-pending application Ser. No. 212,834, filed Dec. 4, 1980, now abandoned.

BACKGROUND OF THE INVENTION

The present invention relates to a door brace adapted to increase securance against unwanted or unauthorized use or entry through a door. The door brace may be used alone or in addition to any lock or latch the door may conventionally have.

While at home or while traveling and staying at motels and hotels, it is an added comfort to be able to insure against unwanted or forced entry into a room where one is staying. This is particularly significant to the elderly or handicapped who often are unable to defend themselves against physical attack, robbery, and the like.

Door braces have generally been previously suggested. U.S. Pat. No. 467,589 to Finegan discloses a door securer consisting of a hollow cylindrical casing. A pointed rod having a threaded butt extends from one end of the casing, and a pronged rod extends from the other end of the casing.

U.S. Pat. No. 503,536 to Hales describes a door securer of two or more sections united by suitable joints so that the sections can be folded together.

U.S. Pat. No. 790,653 to Notthoff also relates to a door securer comprising a jointed prop having a section that may be longitudinally adjusted.

SUMMARY OF THE INVENTION

An object of the present invention is to provide an improved door brace. Another object is to provide a lightweight, portable brace that may be collapsed into a compact form for convenience in travel or storage. A further object is to provide a door brace that may be locked and unlocked from a position outside of the door which is being braced. A still further object is to provide a door brace that is able to signal a warning upon pressure on the brace due to an unauthorized attempt to open the door.

These and other objects are realized by a door brace which, in one form, comprises a plurality of sections interconnected endwise and collapsible with respect to each other to a compact form. One end section of the prop member has means to engage a door, while the other end section of the prop member has pivotally mounted base means to engage the floor.

The sections of the prop member may be collapsed either by pivoting with respect to each other at their ends or by telescoping together. Lock means are preferably included for the base means to hold it in a selected pivotal position.

Optionally, the brace includes lock means which extends from the prop member to an exterior side of the door being secured so as to provide an external lock for the brace. The lock means and brace are locked and unlocked from the exterior side of the door. In another modification, the door brace contains pressure-responsive means actuated by an unauthorized attempt to open the door to signal a warning within the room being secured.

BRIEF DESCRIPTION OF THE DRAWINGS

In the accompanying drawings:

FIG. 1 is a side elevational view of a portable door brace of the present invention in place against a door;

FIG. 2 is a further side elevational view of the door brace of FIG. 1 taken at right angles to that view;

FIG. 3 is a partial section of FIG. 1 on the line 3—3 with pivot and stop pins illustrated in an exploded view;

FIG. 4 is an enlarged view of the lower section of FIG. 2 and has a cut-away portion to show lock means for holding the base means in a selected pivotal position;

FIG. 5 is a plan view of the door brace of FIG. 1 when collapsed to a compact form;

FIG. 6 is a perspective view of a carrying case for a collapsed door brace of the present invention;

DESCRIPTION OF THE PREFERRED EMBODIMENTS

Figure 7:
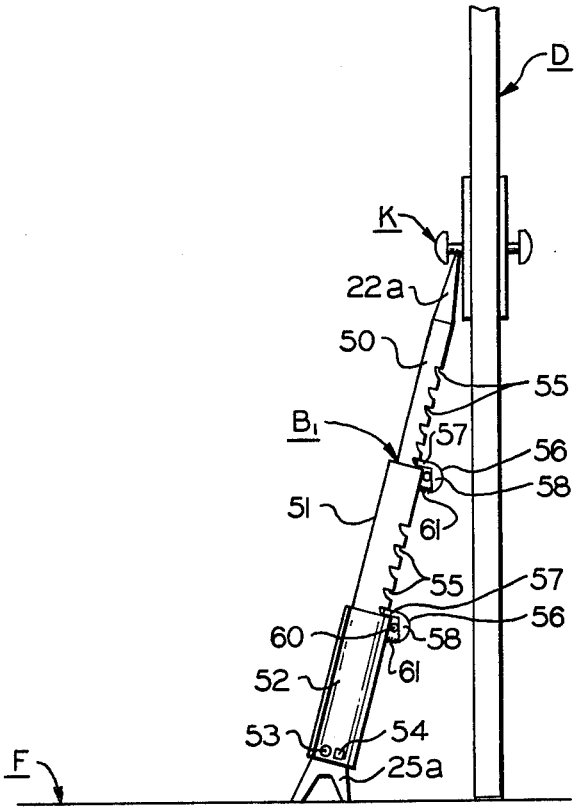
FIG. 7 is a side elevational view of a modified form of door brace.

The drawings illustrate several embodiments and modifications of the present door brace in which it is understood that any embodiment may contain one or more of the modifications, whether or not disclosed in connection with that embodiment.

FIGS. 1 through 6 illustrate one embodiment of a door brace generally indicated at B that is designed to interengage a door D and a floor F beneath the door. Brace B comprises a prop member defined by a plurality of sections 10, 11 and 12 which are longitudinally aligned and pivotally joined together at their adjacent ends. Each section comprises (FIG. 2) a pair of spaced-apart strips, the strips of succeeding sections being somewhat farther spaced apart, so that the strips of a higher section (as viewed in FIG. 2) fit between the strips of a lower section. Thus, section 10 has strips 13 and 14 which fit between strips 15 and 16 of section 11 and are pivotally joined together by pivot pin 17. Similarly, strips 15 and 16 of section 11 fit between strips 19 and 20 of section 12 and are pivotally joined together by pivot pin 21.

At its upper end, section 10 has a nose portion 22 which, when brace B is in position, tightly presses against the underside of a conventional door knob K or its shaft 23 as shown in FIG. 1. For this purpose, nose portion 22 may have a groove 24 partially to encompass shaft 23. At its lower end, section 12 has pivotally mounted base means generally represented at 25 which can move relatively to section 12 about pivot pin 26 so as to be in the best position to resist axial thrust down brace B without being dislodged.

While sections 10, 11 and 12 pivot in a clockwise direction as viewed in FIG. 1 to a collapsed or compact form, as hereinafter more fully described, stop means limit relative clockwise pivoting to an aligned position where the sections define a straight prop member. As one manner of accomplishing this, the upper ends of the strips of sections 11 and 12 are arcuately-shaped as shown in FIG. 1. Sections 10 and 11 have fixed stop pins 28 and 29, respectively, which strike the arcuately-shaped ends of a lower section when sufficient pivoting in a counterclockwise direction has placed sections 10, 11 and 12 in an aligned position.

Base means 25 is similarly attached to the bottom end of section 12. In the illustrated embodiment, base means 25 includes a tripod pedestal 31 which has three depending legs 32, 33, and 34 and includes stop means which limits relative pivoting between section 12 and base means 25. However, in this case, the stop means limits clockwise movement of section 12 as viewed in FIG. 1 with respect to the base means. For this purpose, the lower end of section 12 is arcuately-shaped but in the opposite direction as compared to the lower ends of sections 10 and 11. Pedestal 31 has a stop pin 35 which strikes the arcuately-shaped end of section 12 to prevent further relative movement to a point where base means 25 would be so far to the left of the brace (FIG. 1) as to lose its stability and become more easily dislodged.

While a brace having a freely pivoting base means 25 is quite satisfactory, it may be preferred in some instances to be able to lock the base means to section 12 as a further guard against displacement. FIG. 4 illustrates one modification for accomplishing this. Pedestal 31 of the base means has a stop opening 36 along one side in which a lock pin 37 fits. Pin 37 has an internal flange 38, and opening 36 has a fixed washer 40 blocking the entrance to opening 36 except for a shaft of pin 37. A coiled spring 41 presses against flange 38 and washer 40 so as normally to retain pin 37 in opening 36 and thereby lock the indicated parts together.

This construction can be used for a single opening 36 in pedestal 31 or for a number of such openings 36. In the latter instance, lock pin 37 locks the base means 25 in a selected pivotal position with respect to section 12. When a change is desired, or otherwise to unlock pedestal 31 and section 12, the head of pin 37 is pulled against spring 36 sufficiently for the pin to clear the pedestal. Pedestal 31 and section 12 are then rotated relatively to each other, such as to another opening like opening 36 and pin 37 then allowed to seat. This effects a change in the lock pivotal positions of base means 25 and section 12.

As a rule, there is no difficulty in ramming a present brace under the door knob or the like of any door, regardless of size, and then stationing the base means on the floor in such a manner that the brace rigidly resists any attempt to open the door from the outside. In those instances where relatively minor adjustments are desired to the overall longitudinal length of the door brace, the endwise interconnection of these sections can be adjusted. FIG. 3 illustrates one possible structure for this purpose, using sections 11 and 12 as an example. Strips 15*a* and 16*a* of this modified form of section 11 have a number of openings 43 spaced longitudinally of the strips. When a longitudinal adjustment is desired, pivot pin 21 is removed and strips 15*a* and 16*a* are shifted relatively to strips 19 and 20, respectively, until another opening 43 is aligned with the pivot pin opening in strips 15*a* and 16*a*. Then pivot pin 21 is reinserted. To facilitate removal and insertion of a pivot pin, it may have two heads, one of which is removable; or the pin may make a frictional fit with only one of the two adjacent, interfitting strips and be knocked from position A by a punch tool.

When it is desired to remove brace B, sections 10, 11 and 12 are pivoted relatively to each other in a clockwise direction as viewed in FIG. 1. To start removal, a blow as from a hand may be directed to the interconnection joining sections 11 and 12 in a direction away from door D, after which the sections readily fold together.

One of the advantages of the present brace is that it can be collapsed into a compact form for travel or storage. FIG. 5 illustrates how the sections can be folded into a relatively small volume. It will be noted that section 10 is nested within section 11, and section 11 is nested within section 12. Further, even base means 25 is folded between strips 19 and 20 of section 12 so as to snugly place it as well within the collapsed form.

It is within the contemplation of the present invention to provide a carrying case for the collapsed form of the brace. FIG. 6 illustrates one such case which includes a generally tubular, flexible carrying case 44. The case has closed ends 45 but is open at the top. The collapsed brace sits within case 44. The upper ends 46 of the case has interfitting snap fasteners 47 to close the case about the brace. Handles 48 facilitate carrying the case.

Figure 10:
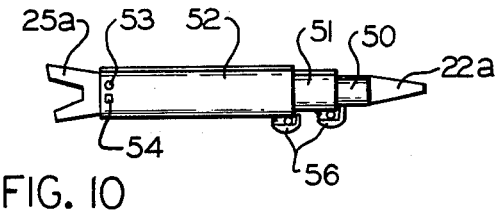
FIG. 10 is a plan view of the door brace of FIG. 7 when collapsed to a compact form.

FIGS. 7 and 10 illustrate another embodiment of the brace in which it retracts to a compact form by telescoping the sections together. In this embodiment, a brace $B_1$ comprises aligned sections 50, 51 and 52. Section 50 has a nose portion 22*a*, and section 52 has tripod base means 25*a* which are similar in construction and operation to the nose portion 22 and base means 25 of the embodiment of FIGS. 1 and 2. In the base means, the pivot pin is represented at 53 and the lock pin at 54.

Sections 50, 51 and 52 are tubular and have increasing internal diameters to permit the telescoping action. The sections have means to lock the sections in an extended position as well as to adjust the overall length of the brace. Sections 50 and 51 have aligned serrations 55 along one side, while sections 51 and 52 have clasps 56 at their upper ends which are designed to engage the serrations of sections 50 and 51. Each clasp includes a finger portion 57 which fits into a serration and a rounded end 58 which is pivotally mounted as at 60 on a section. A spring 61 contained within the rounded end 58 normally urges each clasp in a counterclockwise direction as viewed in FIG. 7 and a finger portion 57 into engagement with a serration 55.

To install a brace of this embodiment, sections 50, 51 and 52 are merely pulled apart until a desired length is reached and then placed in position between door knob K of door D and floor F as before. To retract the brace, clasps 56 are pushed against springs 61 in a clockwise direction to release finger portions 57 from serrations 55, after which the sections telescope together. FIG. 10 illustrates the closed, compact form of the brace $B_1$ which is equally adapted to be transported in the carrying case of FIG. 6.

In another modification, the present brace has an external lock adapted for locking the brace in place while a user is actually absent from the room which is being secured. The locking and unlocking of the brace take place from a position on the outside of door D.

Figure 8:
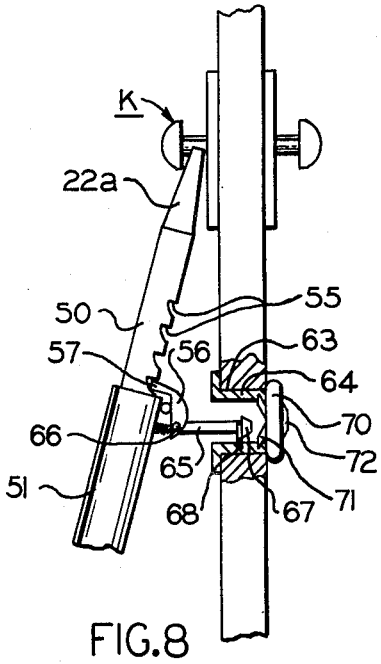
FIG. 8 is a side elevational view similar to FIG. 7 and illustrates one form of an external lock that may be used with the door brace.

FIG. 8 illustrates one form of this embodiment in which the brace of FIG. 7 is used as an example. Door D has an opening 63 lined with a sleeve 64 which is at an elevation on the door approximately opposite to a clasp 56. In this instance, clasp 56 has a small rod 65 pivotally mounted on the clasp as at 66. Rod 65 has an enlarged head 67 at its free end which is caught in a slot (not shown) behind a wall 68. Suitable locking means closes opening 63 from the outside of door D. Such locking means, for example may include a cap having locking fingers 71 which are moved into and out of locking engagement by a key which fits into a keyhole at 72. Such locking caps are commonly used on inlet pipes of gas tanks of automobiles.

To use the embodment of FIG. 8, brace $B_1$ is placed under knob K and head 67 of rod 65 is caught on wall 68. Cap 70 may also be locked in place at this time. When door D is now pulled closed, brace $B_1$ follows the door to its closed position, and the brace is also placed in its closed, locking position as shown in FIG. 7. Upon returning, a user merely unlocks cap 70, lifts rod 65 and uses it to push against clasp 56. This releases finger 57 from a serration 55 and allows the brace from its own weight to retract sufficiently to release the brace from its locking arrangement. Door D can now be opened.

Figure 9:
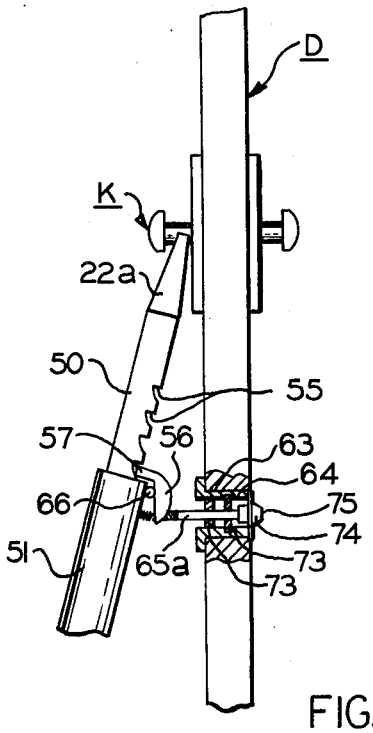
FIG. 9 is a side elevational view similar to FIG. 7 and shows another form of external lock that may be used with the door brace.

FIG. 9 illustrates still another type of exterior lock for placing brace $B_1$ in position when a user is away from the room to be secured. Those parts that are similar to the embodiment of FIG. 8 have the same reference numbers. In this structure, a rod 65*a* threadably engages openings in plates 73 mounted transversely of opening 63 and terminates in a lock 74 carried by door D on the outside of the door. This lock is of the type known as a Greenwalt type of screw lock. Instead of pivotally mounting rod 65*a* on clasp 56, it is carried for rotation by plates 73 and bears against the clasp.

Locking the brace in place is substantially the same as before. With all the parts assembled and locked as desired, the door is closed. Base $B_1$ follows the closing of the door and then braces it against unauthorized opening. When the user returns and places a key in the keyhole 75, turning the key repeatedly advances rod 65*a* sufficiently to the left as viewed in FIG. 9 to trip clasp 56 and collapse brace $B_1$.

Although the use of an outside lock has been described in connection with the embodiment of FIG. 7, it will be understood that it can be adapted as well with the embodiment of FIGS. 1 and 2, in which the rods 65 and 65*a* are operative to pivot the sections so as to release the bracing effect.

The various parts of the present brace may be fabricated from plastic materials, particularly the more rigid, thermosetting plastic materials, or from metals. The use of plastic materials reduces the overall cost of the brace while such materials have been found to be sufficiently rigid to perform as desired. Metals are preferred because of their greater strength and rigidity.

Figure 11:
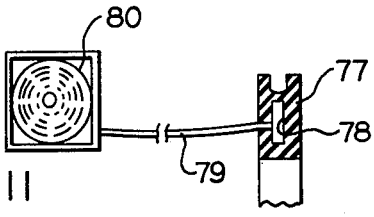
FIG. 11 is a fragmentary view of the top of a door brace of the invention equipped with a pneumatic connection to a warning or signaling device.
Figure 12:
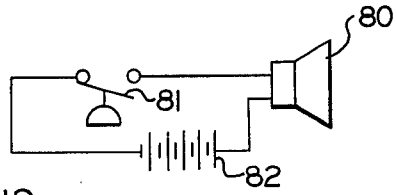
FIG. 12 is a diagram of a circuit that may be used with the warning device of FIG. 11.

In a still further modification of the invention, the brace may be adapted to signal a warning when an unauthorized attempt occurs to open the door. The warning system may include pressure-sensitive means which is actuated by pressure on the brace during such unauthorized use. FIG. 11 illustrates a pneumatic system which can be used, and FIG. 12 shows an electric circuit which can be used in conjunction with the warning system of FIG. 11.

The nose portion of any embodiment may include a sensor. In the embodiment of FIG. 11, a nose portion of an uppermost section comprises a hard rubber nose 77 having a hollow interior 78. A flexible hose 79 connects interior 78 with a pneumatically-operated switch in a circuit which energizes an audio alarm such as a buzzer 80. The buzzer may be attached at any location convenient to door D or nose portion 77 as by a conventional suction cup. As shown in FIG. 12, switch 81 is a conventional, two-pole pneumatically-operated switch and, when closed, operates the buzzer alarm 80 by electrical energy supplied by batteries 82. Instead of a buzzer alarm 80, a visual flasher or other warning device can be used.

Figure 13:
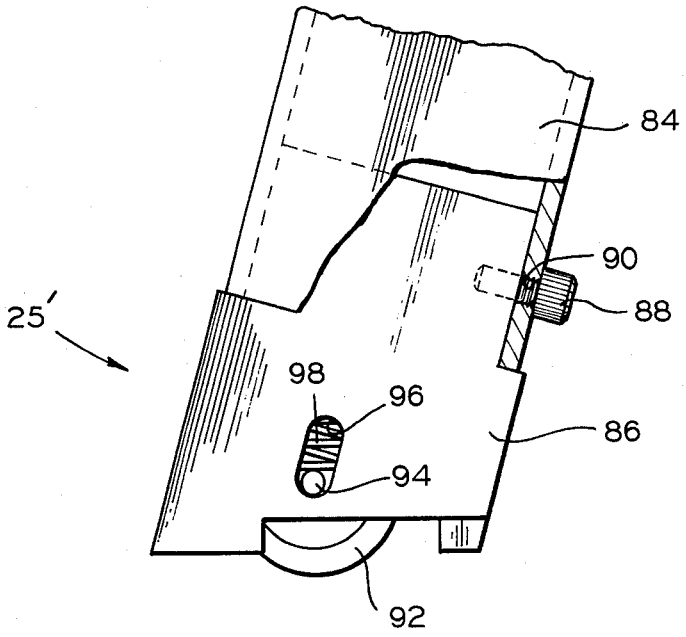
FIG. 13 is an enlarged side elevational view of an alternative embodiment of the base means of the present invention.
Figure 14:
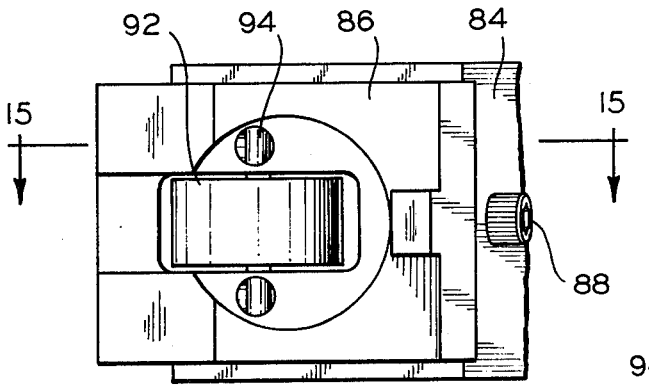
FIG. 14 is a bottom plan view of the base means of FIG. 13.
Figure 15:
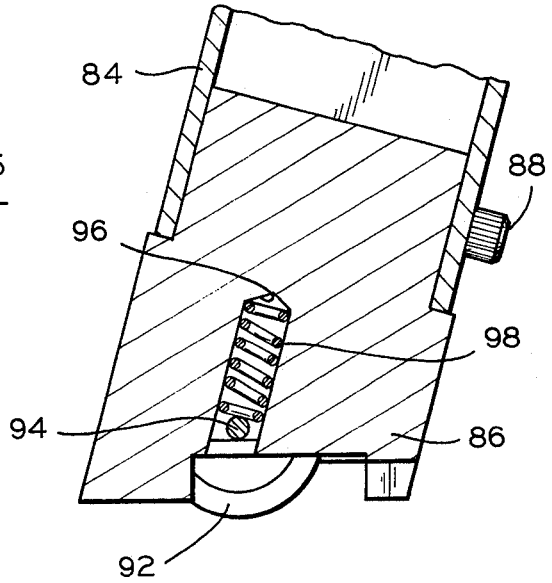
FIG. 15 is a sectional elevational view taken along line 15—15 of FIG. 14.

FIGS. 13, 14, and 15 illustrate an alternative embodiment for the base means 25'. The lowermost section 84 of the door brace is illustrated as a hollow tube having a generally rectangular cross section. The base means 25' includes a generally solid main body 86 having an upper portion which is sized generally in conformance with the interior of the hollow lowermost section 84 of the door brace. A securing means, such as a screw 88, can be provided to removably attach the body 86 of the base means 25' to the lowermost section 84. As illustrated in FIG. 13, the screw 88 extends through an aperture 90 formed in the lowermost section 84 into threaded engagement with the body 86.

A roller 92 or similar roller means, such as a caster, is retained within the body 86 of the base means 25'. The roller 92 is rotatably mounted upon an axle 94. The ends of the axle 94 are slidably maintained in respective slots 96 (only one is illustrated) formed in the body 86. A spring 98 is disposed in each of the slots 96 so as to urge the ends of the axle 94 downwardly toward a first position such that the bottom of the roller 92 normally extends below the bottom edge of the base 86. However, a sufficient force exerted upwardly upon the bottom of the roller 92 will overcome the urging of the springs 98, causing the axle 94 and roller 92 to move upwardly within the body 86 toward a second position such that the roller 92 no longer extends below the bottom edge of the base 86.

In operation, the door brace is positioned against a door generally as described above. The roller 92 permits the base means 25' to be easily rolled into such position. Thereafter, a lateral force applied to the bottom of the door brace will further move the base means 25' towards the door. As a result, a compressive force exerted on the door brace by the door knob such that the urging of the spring 98 will be overcome and the roller 92 will be pushed upwardly within the body 86. Accordingly, the bottom edge of the body 86 will thereafter engage the floor to securely maintain the door brace in position. When the door brace is removed as described above, the compressive force exerted on the door brace will be released, thereby allowing the roller 92 to move downwardly below the bottom edge of the body 86 to facilitate easy removal of the door brace.

Although the foregoing describes several embodiments of the present invention, it is understood that the invention may be practiced in still other forms within the scope of the following claims.

I claim:

1. A door brace adapted to interengage a door knob or the like on a door and a floor beneath the door comprising:

a plurality of sections interconnected substantially end-to-end and collapsible with respect to each other into a compact form;

means adapted to engage the door knob or the like on the door formed in one end section of said plurality of sections; and base means formed in the other end section of said plurality of sections, said base means including a main body, means for releasably securing said main body to said other end section, roller means rotatably retained within said main body and movable between a first position wherein said roller means extends below the bottom edge of said main body and a second position wherein said roller means does not extend below the bottom edge of said body, and means for urging said roller means toward said first position such that said roller means normally extends below the bottom edge of said main body.

2. The invention defined in claim 1 wherein said sections telescope together in collapsing to said compact form.

3. The invention defined in claim 2 further including releasable lock means to secure one section relative to another.

4. The invention defined in claim 2 further including means for longitudinally adjusting said interconnected sections with respect to each other such that the overall length of said door brace can be varied.

* * * * *